US009833097B2

(12) United States Patent
Byers et al.

(10) Patent No.: US 9,833,097 B2
(45) Date of Patent: Dec. 5, 2017

(54) SMART POSTAL BOX IN SUPPORT OF AUTONOMOUS DELIVERY NODES

(71) Applicant: Cisco Technology, Inc., San Jose, CA (US)

(72) Inventors: Charles Calvin Byers, Wheaton, IL (US); Gonzalo Salgueiro, Raleigh, NC (US); Aparna Vellala, Bangalore (IN); Salini Kumar Bogadapati, Bangalore (IN); Jagadish Chandra Prasad Mynampati, Bangalore (IN)

(73) Assignee: Cisco Technology, Inc., San Jose, CA (US)

( * ) Notice: Subject to any disclaimer, the term of this patent is extended or adjusted under 35 U.S.C. 154(b) by 82 days.

(21) Appl. No.: 14/621,927

(22) Filed: Feb. 13, 2015

(65) Prior Publication Data

US 2016/0235236 A1 Aug. 18, 2016

(51) Int. Cl.
*A47G 29/14* (2006.01)

(52) U.S. Cl.
CPC ..... *A47G 29/141* (2013.01); *A47G 29/14* (2013.01); *A47G 2029/146* (2013.01); *A47G 2029/147* (2013.01); *A47G 2029/149* (2013.01)

(58) Field of Classification Search
CPC ..... A47G 29/122; A47G 29/1201; A47G 29/1212; A47G 29/1214; A47G 29/1226; A47G 29/124; A47G 29/141; A47G 29/16; A47G 29/30; A47G 2029/145–2029/149; A47G 29/14; G06Q 10/083; E05D 15/38; E05D 15/165; E05D 15/24; B65D 25/04
USPC ..... 232/17, 19, 24, 25, 45; 700/214; 340/5.73, 569, 545.6; 220/525, 530, 252; 49/197, 199; 160/201, 36
See application file for complete search history.

(56) References Cited

U.S. PATENT DOCUMENTS 4,894,717 A * 1/1990 Komei ..... A47G 29/141 348/14.01
5,223,829 A * 6/1993 Watabe ..... G07F 17/12 235/382.5
5,231,272 A * 7/1993 Mardon ..... G07F 17/12 235/382
5,774,053 A * 6/1998 Porter ..... A47G 29/141 232/19
5,979,750 A * 11/1999 Kindell ..... A47G 29/141 232/1 R
6,323,782 B1 * 11/2001 Stephens ..... G07C 9/00103 340/10.31
6,715,669 B2 * 4/2004 Hara ..... G07C 9/00103 232/19
7,191,932 B2 * 3/2007 Fobbe ..... A47G 29/141 232/19
7,337,944 B2 * 3/2008 Devar ..... A47G 29/141 232/19
7,913,898 B2 * 3/2011 Frankenberg ..... A47G 29/122 160/36

(Continued)

*Primary Examiner* — William Miller
(74) *Attorney, Agent, or Firm* — Parker Ibrahim & Berg LLC; James M. Behmke; Stephen D. LeBarron

(57) ABSTRACT

In one embodiment, a controller determines a particular compartment of a smart postal box in which a package is to be delivered. The controller associates the particular compartment with an authorized entity. The controller provides the authorized entity access to the particular compartment by aligning rolling doors of the smart postal box with the particular compartment.

18 Claims, 8 Drawing Sheets

(56) References Cited

U.S. PATENT DOCUMENTS

| | | | | |
|---|---|---|---|---|
| 8,714,669 | B1 * | 5/2014 | Clausen | A47B 49/004 160/37 |
| 2001/0045449 | A1 * | 11/2001 | Shannon | A47G 29/141 232/19 |
| 2006/0151588 | A1 * | 7/2006 | Mikolajczyk | A47G 29/1201 232/24 |
| 2013/0264381 | A1 * | 10/2013 | Kim | G07F 17/12 232/24 |
| 2015/0339872 | A1 * | 11/2015 | de Puiseau | G06Q 10/083 340/5.5 |
| 2016/0025365 | A1 * | 1/2016 | Moudy | F24F 11/006 700/276 |
| 2016/0066732 | A1 * | 3/2016 | Sarvestani | A47G 29/1201 232/24 |
| 2016/0300187 | A1 * | 10/2016 | Kashi | G06Q 10/0832 |

* cited by examiner

SMART POSTAL BOX IN SUPPORT OF AUTONOMOUS DELIVERY NODES

TECHNICAL FIELD

The present disclosure relates generally to an intelligent postal box and, more particularly, to an intelligent postal box that supports delivery from autonomous delivery nodes.

BACKGROUND

With the rapid rise in e-commerce sales, more and more goods are being delivered to residential and business addresses. As a result, parcel delivery services are now experiencing record delivery volumes. This increased volume has also led to corresponding increases in road traffic, energy use, and labor expenses, in an effort to continue meeting society's demand for delivered goods.

In general, attempts to streamline the parcel delivery process have focused on central distribution facilities. In particular, many parcel delivery services now utilize large delivery hubs that coordinate deliveries from centralized locations. Within a given hub, packages may be sorted and routed for delivery. However, deliveries from the hub to the addressees still require a fleet of delivery vehicles. For example, a package may be loaded onto a delivery truck at a local hub and driven by a delivery driver to the final destination. Once there, the delivery driver may manually carry the package along the final leg of the delivery route from the delivery truck to the drop off location (e.g., the front steps of a house, the foyer of an apartment complex, etc.).

In some cases, a delivery service may attempt to deliver a package multiple times to an addressee. For example, certain goods may require a signature confirmation from the addressee, to ensure that the delivered goods are actually received by the addressee. If the addressee is unavailable at the time of delivery, the delivery driver may be forced to return the package to the hub and attempt re-delivery of the package at a later date.

BRIEF DESCRIPTION OF THE DRAWINGS

The embodiments herein may be better understood by referring to the following description in conjunction with the accompanying drawings in which like reference numerals indicate identically or functionally similar elements, of which.

DESCRIPTION OF EXAMPLE EMBODIMENTS

Overview

According to one or more embodiments of the disclosure, a controller determines a particular compartment of a smart postal box in which a package is to be delivered. The controller associates the particular compartment with an authorized entity. The controller provides the authorized entity access to the particular compartment by aligning rolling doors of the smart postal box with the particular compartment.

In another embodiment, a postal box is disclosed. The postal box includes a plurality of shelves that define a plurality of internal compartments of the postal box. The postal box also includes a plurality of rolling doors that, when actuated, are configured to expose a particular one of the compartments in which a package is to be delivered. The postal box also includes a controller configured to associate the particular compartment with an authorized entity and provide the authorized entity with access to the particular compartment by aligning the rolling doors with the particular compartment.

In a further embodiment, a controller receives a compartment reservation request for a smart postal box. The controller determines an arrival time of a package to be delivered to the smart postal box based on the compartment reservation request. The controller selects a particular compartment of the smart postal box to be reserved for the package based on the compartment reservation request and the arrival time of the package. The controller detects an approach of the package. The controller opens the particular compartment by aligning rolling doors of the postal box with the particular compartment, in response to the detected approach of the package.

DESCRIPTION

The techniques herein provide a smart postal box that includes secured, highly structured repositories for packages delivered by autonomous road vehicles, unmanned aerial vehicles (UAVs), or other delivery entities. In some embodiments, the smart postal box includes a plurality of storage compartments to manage independent deliveries, with the optional capability of regulating the internal temperature of each compartment. Further techniques are disclosed herein that support the charging of delivery UAVs, accommodating the delivery of over-sized packages, providing security to delivered packages, and other mechanisms that help facilitate the autonomous delivery of packages.

Figure 1:
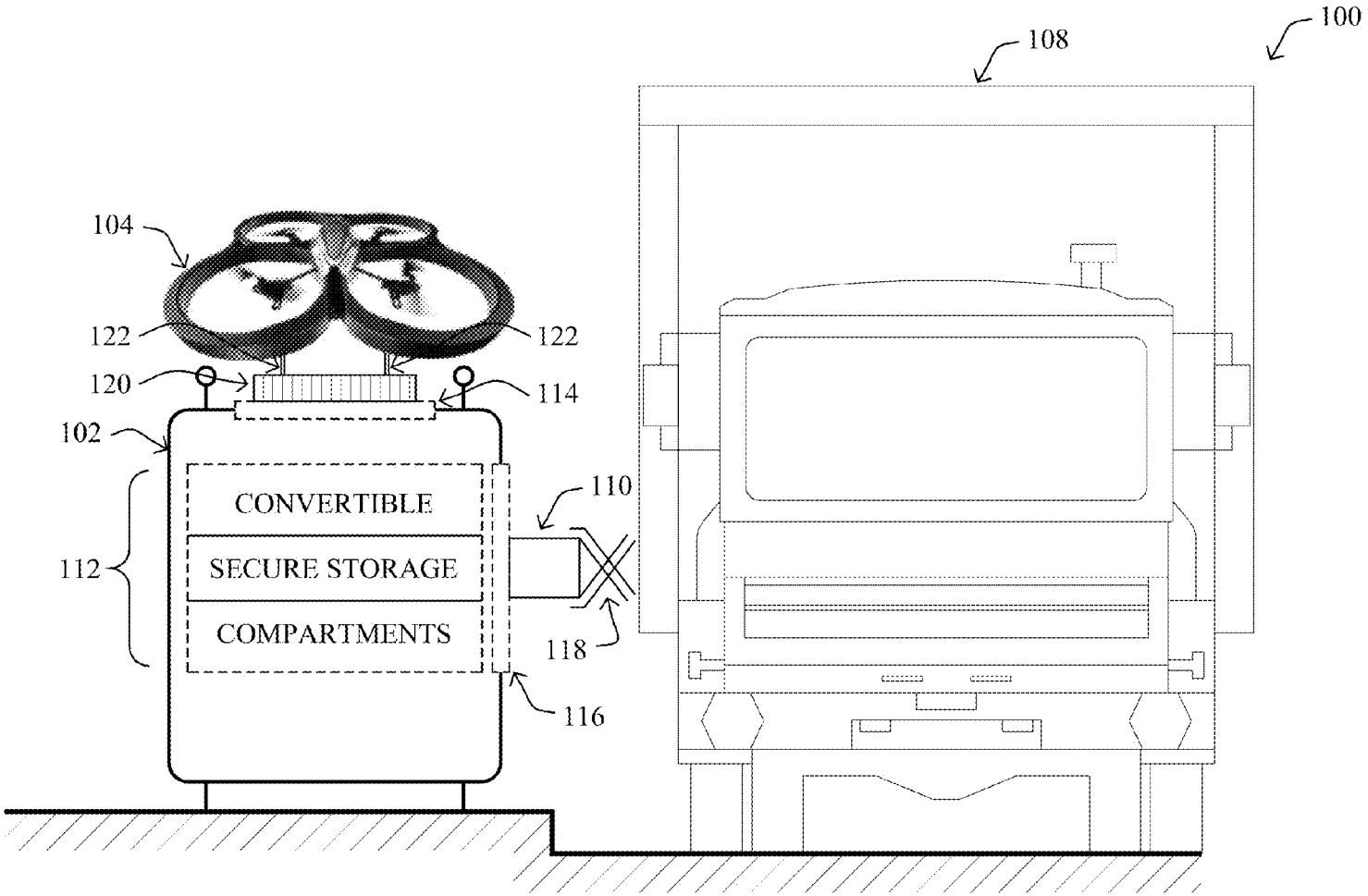
FIG. 1 illustrates an example package delivery system.

Referring now to FIG. 1, an example package delivery system 100 is shown, according to various embodiments. As shown, package delivery system 100 may include a smart postal box 102. In general, smart postal box 102 may be configured to provide access to any or all of the following entities: a road vehicle 108 (e.g., a delivery truck which may be operated by a human driver or driven autonomously), a human delivery carrier, a delivery UAV 104 (e.g., a quad-copter, an octo-copter, etc.), and/or one or more users associated with smart postal box 102 as authorized recipients of a package. Illustratively, smart postal box 102 may be located on the side of a street to provide access to road vehicle 108. However, in other implementations, smart postal box 102 may be located in other locations such as, but not limited to, on the rooftop of a building, near the entryway of a building, or in any other location that can be accessed by delivery UAV 104 and/or vehicle 108.

Smart postal box 102 may include one or more internal compartments 112 that may store one or more delivered packages until retrieval by an authorized recipient (e.g., the addressee of the package, the delegated recipient by the addressee, etc.). For example, as shown, road vehicle 108 may access one of the compartments 112 of smart postal box 102 via a first aperture 116 and operate a robotic gripper 118 to place package 110 into one of compartments 112. In another example, delivery UAV 104 may deposit a package 120 into one of compartments 112 via an aperture 114 located at the top of smart postal box 102. In one embodiment, delivery UAV 104 may include robotic equipment 122 to deposit package 120 into smart postal box 102 and/or retrieve a package therefrom. For example, equipment 122 may be configured to grip or otherwise couple delivery UAV 104 to package 120 and may be powered, e.g., by magnets, motors, cables, pneumatics, or the like. On completion of delivery, smart postal box 102 may close apertures 114 or 116, thereby securing the delivered package(s) 110 or 120 within compartments 112, until retrieval by an authorized recipient.

Smart postal box 102 may be of any number of different sizes or shapes. For example, in one embodiment, smart postal box 102 and compartments 112 may be sized to accept and store up to three parcels having dimensions of up to 500 mm (width)×500 mm (depth)×200 mm (height). The storage compartments 112 for all three parcels may be isolated and individually secured, so if multiple deliveries are received between the times the recipients retrieve the packages from smart postal box 102, all stored packages remain secure. For example, after delivery, later delivery agents (e.g., a human or autonomous device) may not have access to a compartment that is currently storing a delivered package. In some embodiments, smart postal box 102 may also be configured to adjust the sizes and/or numbers of compartments 112. For example, the volumes of two or three of compartments 112 may be combined mechanically to accommodate a single tall parcel of maximum size 500 mm (width)×500 mm (depth)× 600 mm (height). Notably, this size range covers most everything traditionally delivered by the postal service, fast food and grocery deliveries, luggage within the FAA carry-on limits, and more than 80% of the packages delivered by typical parcel delivery services.

Figure 2B:
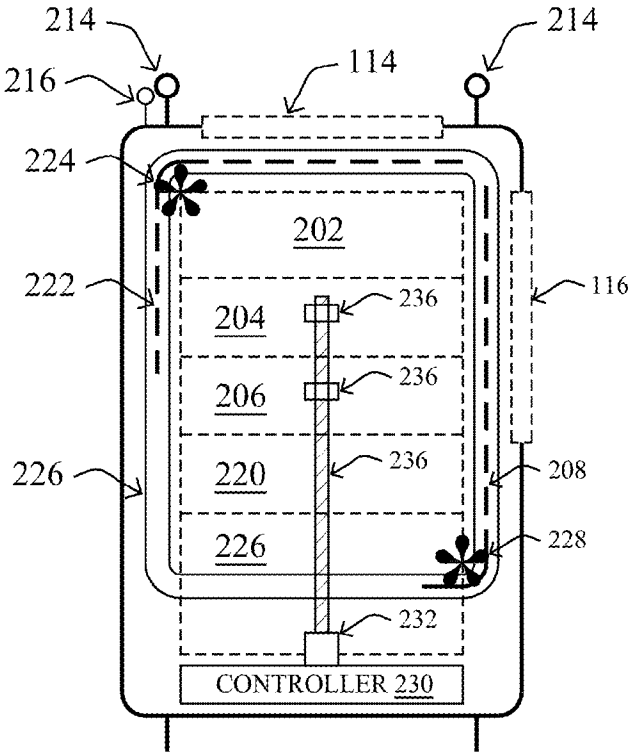
FIG. 2B illustrates an example side cross-sectional view of the smart postal box of FIG. 2A.
Figure 2A:
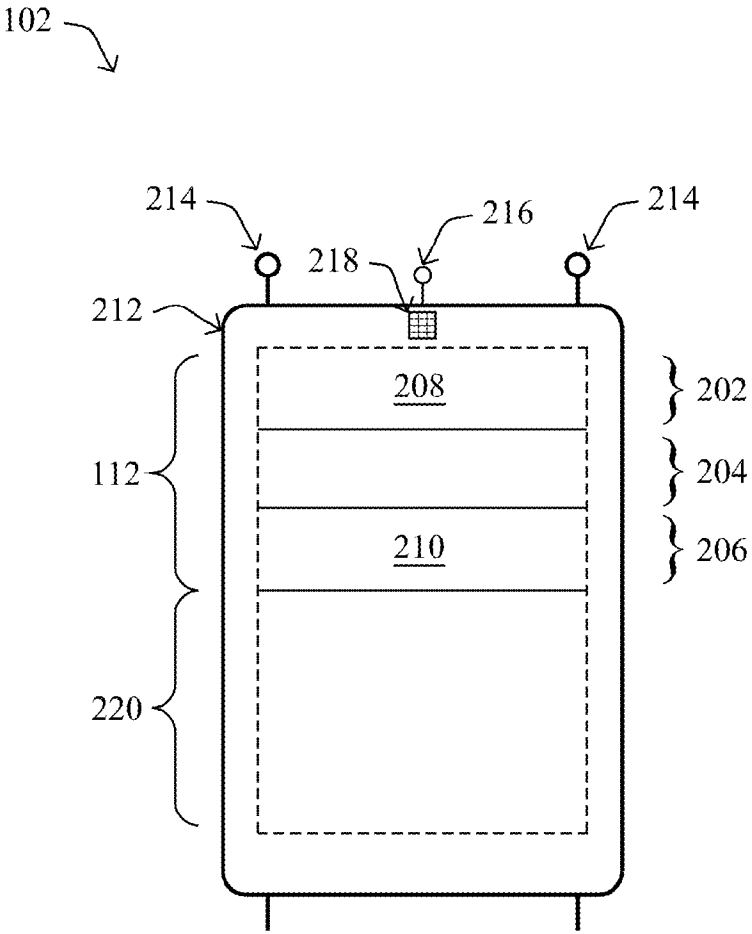
FIG. 2A illustrates an example front cross-sectional view of a smart postal box.

Referring now to FIGS. 2A-2B, front and side cross-sectional views of smart postal box 102 are shown, according to various embodiments. In some cases, one or more beacon lights 214 may be located on the top of smart postal box 102. During operation, beacon lights 214 may be used by autonomous vehicles (e.g., delivery UAV 104 or truck 108) to locate and fine align their package handling systems with the internal compartments 112 of smart postal box 102. In particular, one or more cameras on the vehicle may scan beacon lights 214, and calculate their geometric relationships with the inner storage compartments 112 (e.g., which may be standardized over the network of smart postal boxes and the vehicles that use them). If beacon lights 214 are commanded to enter high power mode and modulated with a unique code, a UAV 104 can use them to locate a specific smart postal box from long distances, and perform precise, efficient approaches. In some embodiments, as described in greater detail below, beacon lights 214 may be located on posts that can also function as landing hold-down perches for the delivery UAVs.

Referring specifically to FIG. 2A, a cross-sectional view of the front of smart postal box 102 is shown. In many cases, the front of smart postal box 102 may be positioned facing a roadway, to allow a road vehicle (e.g., road vehicle 108) to deposit packages within compartments 112 of smart postal box 102. As shown, compartments 112 may include a topmost compartment 202, a middle compartment 204, and a bottom compartment 206. In some cases, smart postal box 102 may also include additional space 220 that may be used to size compartments 112, as needed.

In various embodiments, smart postal box 102 may control access to compartments 112 by actuation of a sliding side door 208, as detailed below and shown in FIG. 2B. For example, sliding side door 208 may be rolled upward, to provide an access aperture 210 to compartment 206 (e.g., a portion of aperture 116 that corresponds to compartment 206). In some cases, sliding side door 208 may be controlled such that access is provided only to an individual compartment 112 (e.g., one of compartments 202-206), thereby ensuring the security of other the other compartments. User access to compartments 112 may be controlled via a keypad 218 or via a command sent to smart postal box 102 over a wireless network. For example, smart postal box 102 may include an antenna 216 that allows smart postal box 102 to join a data network (e.g., a cellular network, a user's home network, etc.) and/or communicate with nearby vehicles (e.g., UAVs, autonomous road vehicles, etc.).

A side cross-sectional view of smart postal box 102 is shown in FIG. 2B. As shown, smart postal box 102 may include sliding side door 208 and/or sliding top door 222. In some embodiments, doors 208 and 222 may operate in a sliding manner (e.g., similar to a roll-top desk cover or hurricane shutters), with a number of connected slats being driven up and down along a track 226. These slats may be constructed using strong materials to resist physical attacks attempting to gain unauthorized access to the internal compartments 112 and to isolate compartments 112 from the elements. In the configuration shown, doors 208 and 222 are positioned such that they completely cover apertures 114 and 116, thereby securing the contents of compartments 202-206 from outside access.

In one embodiment, doors 208 and 222 may be guided within an inner track 226 by motorized cogs 228 and 224, respectively. Cogs 228, 222 may engage perforations in the chains of slats of doors 208, 222 and drive the two sets of roll doors to their commanded positions. Cog 228 may be operable to pull door 208 partially downward, to expose the top compartment 202, move fully downward to expose top and middle compartments 202-204, or completely downward to expose all of compartments 202-206. Cog 224 can drive door 222 in one direction to expose aperture 114 on the top of smart postal box 102 (e.g., used by UAVs) and can also be driven in the opposite direction to cover top aperture 114, or top aperture 114 and the portion of aperture 116 that corresponds to compartment 202 (e.g., to prevent access to compartment 202 via aperture 116), or driven even further to cover top aperture 114 and the portions of aperture 116 that correspond to compartments 202-204. Notably, by coordinating the position of both roll doors 208 and 222, aperture 114 and/or various combinations of side openings via aperture 116 can be securely exposed, without allowing access to other compartments. Said differently, doors 208, 222 may operate in conjunction with one another, to provide individualized access to compartments 202-206.

In some embodiments, the lower compartments 204-206 may be defined by a pair of moving shelves 236-238 that are respectively coupled to a threaded leadscrew 234. A drive motor 232 located at the base of smart postal box 102 may move shelves 236-238 up or down within smart postal box 102, to size compartments 204-206. For example, motor 232 may move shelves 236-238 up or down within a range of approximately 400 mm. When motor 232 is driven to its highest position, three independent compartments 202-206 may be defined, each having the same height (e.g., 200 mm high). If leadscrew 234 is lowered 200 mm, a top compartment of 400 mm height and a lower 200 mm compartment may be configured. Similarly, if leadscrew 234 is driven down 400 mm, thereby moving shelves 236-238 below aperture 116, a single 600 mm tall compartment may be configured, allowing smart postal box 102 to accommodate particularly large packages. In one embodiment, if compartments 204-206 have already been filled, they can be lowered into space 226, thereby supporting multi-delivery of packages.

As described in greater detail below, smart postal box 102 may include a controller 230 that manages the operations of antenna 216, beacon light(s) 214, doors 208 and 222, and any other operations described herein with respect to smart postal box 102. For example, controller 230 may analyze a security code entered via keypad 218, determine whether the security code is valid for one of compartments 202-206 and, if so, actuate door 208 to provide access to the corresponding compartment.

In some embodiments, the slats of top door 222 may be covered with solar cells, allowing smart postal box 102 to harvest solar energy and store the generated electricity in batteries or ultra-capacitors as needed. In another embodiment, the walls of compartments 202-206 may be thermally insulated and provided with thermo-electric modules (not shown). By driving these modules at one polarity, heat may be moved from the internal compartment to the outer enclosure of smart postal box 102 and dissipated in the surrounding air, thereby refrigerating the internal compartment. Driving the modules at the opposite polarity may move heat from the outside wall of smart postal box 102 to the inner compartment, heating the compartment. Thermostats may also be used to regulate the temperature in each of compartments 202-206 to values recommended by the shipper for each package. This allows smart postal box 102 to keep groceries cold, food deliveries hot, etc., while waiting for the recipient to retrieve the delivered package.

Figure 3:
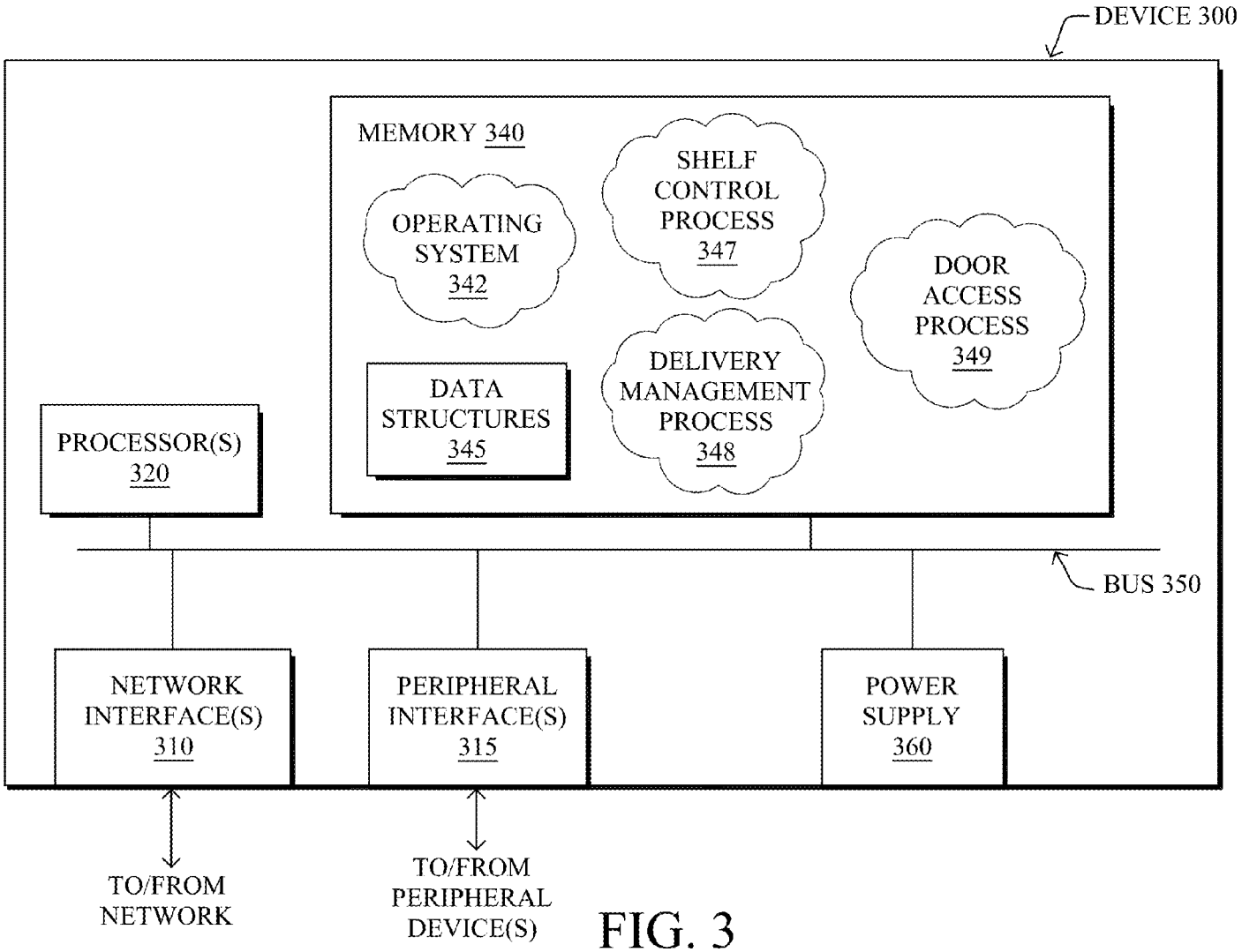
FIG. 3 illustrates an example controller for a smart postal box.

FIG. 3 is a schematic block diagram of an example controller 230 that may be used with one or more embodiments described herein. Controller 230 may include one or more network interfaces 310, one or more peripheral device interfaces 315, one or more processors 320, and a memory 340 interconnected by a system bus 350 and powered by a power supply system 360.

The network interface(s) 310 include the mechanical, electrical, and signaling circuitry for communicating data over wireless and/or wired links of a communication network. In some embodiments, network interface(s) 310 may include a wireless interface that supports Wi-Fi, cellular, free-space optical communications, or other wireless technologies to connect smart postal box 102 to a nearby Wi-Fi network, 3G/4G cellular data network, nearby device, UAV, etc. In other embodiments, network interface(s) 310 may include an interface for a hardwired network connection such as a Power over Ethernet (PoE) port connected to a nearby building by a buried Cat 5/7 cable, a fiber optic connection, or the like. Such a hardwired data connection may, in some cases, also provide the power needed to run the cabinet over the same physical cable. In another embodiment, network interface(s) 310 may include a near-field communication interface that uses Bluetooth or any of the emerging Internet of Things (IoT) wireless options, to communicatively connect smart postal box 102 to any other nearby device. For example, a delivery vehicle (e.g., UAV, road vehicle, etc.) may communicate with smart postal box 102 via this interface when in range. In another example, a smartphone, tablet, or other portable electronic device operated by a human user (e.g., delivery person or package recipient) may communicate with smart postal box 102 via this interface.

Peripheral interface(s) 315 include the mechanical, electrical, and signaling circuitry for communicating data to and/or from any of the peripheral components of smart postal box 102. For example, controller 230 may provide control signals to any of motorized cogs 224, 228 or to motor 232, to actuate doors 222, 208, or leadscrew 234 (e.g., to adjust shelves 236-238). These motor systems may include bi-directional power drivers, breaks, position and speed feedback sensors, or current monitors, to detect if a moving part is obstructed (e.g., a user's hand is present, etc.) and to shut down the motor if an unsafe condition is detected. In another embodiment, peripheral interfaces 315 may provide control commands to thermo-electric coolers that use the Peltier effect to provide heating or cooling within any of the compartments 112 of smart postal box 102. In such a case, if the module is energized using one polarity, the inside of the compartment may be heated and, if energized using the opposite polarity, the compartment may be cooled. For example, up to three independent sets of thermo-electric modules may be provided individually to compartments 202-206, along with the required power control and temperature sensors that communicate with controller 230 via interfaces 315. Other heating and/or cooling mechanisms may also be controlled, in other embodiments. Further peripherals that may receive control commands from controller 230 and/or provide data to controller 230 via interfaces 315 may include, but are not limited to, cameras, microphones, security sensors, marker lights, keypads, electronic displays, environmental sensors/monitors, or the like. In some cases, peripheral beacon lights 214 may provide an optical data link with a delivery UAV by flashing codes that provide specific identification and status information to the approaching UAV.

Power supply system 360 may be configured to manage the potentially bursty energy needs of smart postal box 102. In various embodiments, power supply system 360 may receive energy over a PoE network interface 310, from a solar panel (e.g., located at the top of smart postal box 102), via an AC power supply line (e.g., a buried 12V AC distribution line), or from a storage cell (e.g., a battery, an ultra-capacitor, etc.). In general, power supply 360 provides power to both controller 230 and to the various systems/components of smart postal box 102. When batteries are used, they may require a fairly substantial energy reserve (e.g., 48V at approximately twelve amp-hours). Other example power draws within smart postal box 102 may include 100 Watt draws for the box's motors, 50 Watt draws each for any internal heating or cooling elements, up to 2000 Watt draws to charge a docked UAV, etc. As would be appreciated, power supply system 360 may be sized and configured accordingly, to accommodate any number of different devices and/or functions.

The memory 340 includes a plurality of storage locations that are addressable by the processor(s) 320 and the interfaces 310, 315 for storing software programs and data structures associated with the embodiments described herein. The processor 320 may comprise necessary elements or logic adapted to execute the software programs and manipulate the data structures 345. An operating system 342, portions of which are typically resident in memory 340 and executed by the processor(s) 320, functionally organizes data by, inter alia, invoking operations in support of software processors and/or services executing on controller 230. Illustratively, these software processes and/or services may include a shelf control process 347, a door access process 349, and/or a delivery management process 348 that are configured to perform the operations described herein.

It will be apparent to those skilled in the art that other processor and memory types, including various computer-readable media, may be used to store and execute program instructions pertaining to the techniques described herein. Also, while the description illustrates various processors, it is expressly contemplated that various processors may be embodied as modules configured to operate in accordance with the techniques herein (e.g., according to the functionality of a similar process). Further, while processors may be shown and/or described separately, those skilled in the art will appreciate that processors may be routines or modules within other processors.

During operation, controller 230 may use cloud computing techniques (e.g., centralized processing from one or more remote servers) or fog computing techniques (e.g., extending the cloud computing paradigm to the edges of the network), to coordinate the operations of all of the sensors, actuators, and networking functions of smart postal box 102. For example, controller 230 may not have a persistent Internet connection or have a limited bandwidth Internet connection. In such cases, controller 230 may be configured to exchange data (e.g., delivery confirmations, status information, compartment requests, etc.) with another device (e.g., a delivery vehicle, a user device, etc.) that forwards the information to a central server.

In some embodiments, delivery management process 348 may accesses the delivery vehicle's networks to determine when delivery vehicles are expected and utilize processes 347, 349 to configure the internal shelves, doors, and optional temperature controls correctly when a package is expected. In other cases, delivery management process 348 may interface with the recipient's network, to provide alerts when deliveries are occurring, manage security for sensitive deliveries, and perform other functions. For example, as described in greater detail below, delivery management process 348 may exchange security information with a remote server, thereby allowing a user to schedule a secured pickup of a delivery.

Figure 4:
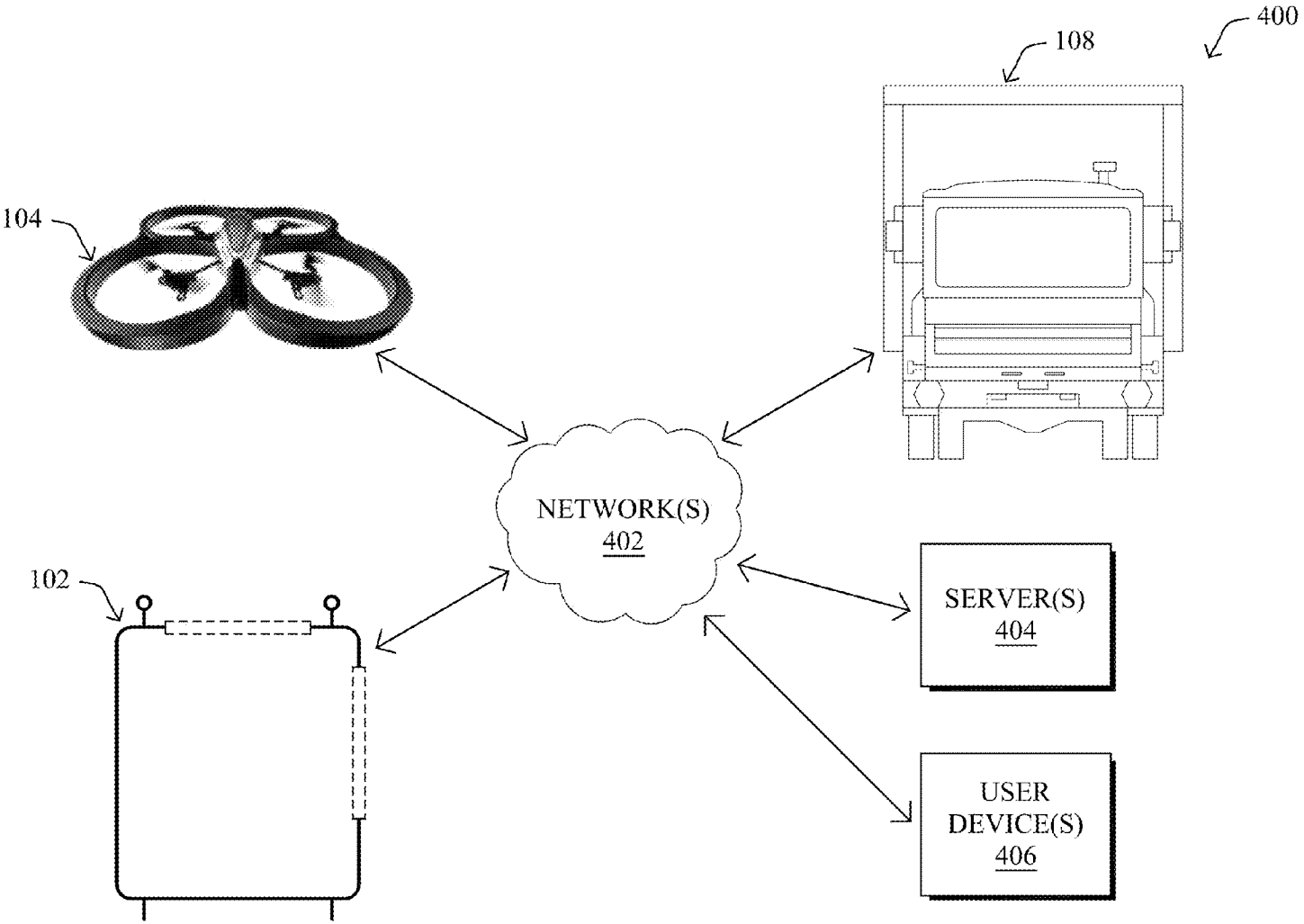
FIG. 4 illustrates an example communication system for a delivery service.

Referring now to FIG. 4, an example communication system 400 is shown, according to various embodiments. As shown, smart postal box 102 may communicate with any number of delivery vehicles (e.g., UAV 104, road vehicle 108, etc.), any number of servers 404, and/or user devices 406 via one or more networks 402. Network(s) 402 may include, but are not limited to, wireless, hardwired, optical, near-field, and other forms of communication links between the various entities in system 400.

In some embodiments, system 400 may use various web and network infrastructure technologies to optimize its efficiency and user experience. For example, smart postal box 102, vehicles 104, 108, servers 404 and user devices 406 may be HTML5 enabled, to take advantage of the advanced real-time communication and other web-based features offered by this protocol. In one embodiment, smart postal box 102 and vehicles 104, 108 may operate as full-featured web servers, used to enable machine-to-machine, machine-to-human, and/or human-to-human communications modes. Advanced versions of smart postal box 102 can include a full-featured set of peripherals that are fully accessible from these web servers, including microphones, speakers, video cameras, displays, card readers, keyboards, pointing devices, biometric scanners, wireless and near-field communications access points, a global positioning system (GPS), etc. Such peripherals may also be integrated into advanced web-based services.

Machine-to-machine communications within system 400 may support capabilities such as, but not limited to, automated audio/video/IM code relay, automated navigation assistance, delivery update, security (e.g., IP-based audio/video surveillance), approach alignment, actuator control, etc. Machine-to-human modes may enable smart postal box 102 to communicate with its owner or other user via a user device 406, and enable the delivery vehicle (e.g., UAV 104, vehicle 108, etc.) to communicate with its fleet manager, providing service-like configuration, authentication, remote troubleshooting, and/or accessibility (e.g., improved communication for customers that are blind, deaf, or suffer other such impairments), etc. Human-to-human modes could use smart postal box 102 and/or a delivery vehicle to help create a higher class of service connection between humans (e.g., up to video telepresence quality) for interactive audio/video service assistance, real-time customer care, a panic button, troubleshooting, etc. Because of its reliability and low latency, Web Real-time Communications (WebRTC) technology may be used to provide these services, in one embodiment.

The devices in system 400 may also use automated information discovery techniques, to obtain timely delivery information from any of the devices shown. In one embodiment, the automated discovery may use the Webfinger protocol detailed in the Internet Engineering Task Force (IETF) Request for Comments (RFC): 7033 by P. Jones, et al., which may allow lookup of public parameters of smart postal box 102 (e.g., its location, configuration, public cryptography key codes, full state of compartments, etc.) or an associated user of smart postal box 102 (e.g., an email address, SMS address, social networking profile, etc.), to automate the otherwise difficult and error-prone process of providing this information for the service to use.

In another embodiment, smart postal box 102 may use WiSee to support motion sensing (e.g., landing/takeoff preparations, security, etc.) and gesture recognition (e.g., pickup readiness, etc.). For example, if user device 406 is Wi-Fi enabled, the user could hold it in his or her hand and make a gesture that can be sensed by smart postal box 102. Based on the RF signal characteristics of the received signal, smart postal box 102 may then unlock a corresponding compartment to provide access to the user, after determining that the user is authorized to access the compartment. In another example, an autonomous delivery vehicle (e.g., UAV 104 or vehicle 108) could use WiSee to estimate its closing speed in relation to smart postal box 102.

An example of system 400 in operation is as follows. An autonomous delivery vehicle (e.g., UAV 104 or vehicle 108) may be loaded with the package to be delivered and dispatched to the location of smart postal box 102 by a central scheduling service hosted by one of server 404. As the vehicle approaches the GPS location of smart postal box 102, the vehicle may send a message to smart postal box 102 that causes it to activate its beacon lights. In some cases, the message may also include delivery information such as the dimensions and/or temperature requirements of the package to be delivered. In response, smart postal box 102 may size its internal compartments accordingly and/or adjust the internal temperature of the compartment that will receive the package. While approaching smart postal box 102, the vehicle may photograph smart postal box 102 and its beacon lights and use this information to correctly align itself with smart postal box 102. For example, UAV 104 may land on the top of smart postal box 102 and be supported by the beacon posts located at the top of smart postal box 102. In another example, road vehicle 104 may use the beacons to set its distance from smart postal box 102 and position itself along the road to be within the range of its package handling robot). Once the vehicle is parked in position, it may open a network session with smart postal box 102. After performing security checks, such as those described in greater detail below, smart postal box 102 may actuate its doors to expose the opening to the receiving compartment(s). Robotic systems retrieve the package to be delivered from the on-vehicle storage racks or UAV, and move the package into the opened compartment in smart postal box 102. Once the vehicle and smart postal box 104 agree that the delivery is complete, the compartment doors close to secure the package, and the vehicle may leave for another delivery or return to a central location.

In response to delivery of a package, smart postal box 102 may send an alert (e.g., a text message, voice announcement, package waiting icon, doorbell actuation, etc.) to the user device 406 associated with the addressee of the delivered package. The addressee or another authorized recipient may then visit smart postal box 102, enters credentials for validation by smart postal box 102 (e.g., by proximity with a smart device or tag carried by the recipient, by communication with a smartphone application, by entering a PIN on the cabinet's control keypad, etc.). Once the credentials are verified with the shipper (e.g., including checking the recipient is of adequate age to handle controlled cargo, the recipient is authorized to handle valuable cargo, etc.), smart postal box 102 opens the appropriate door, and the user retrieves the package.

Figure 5A:
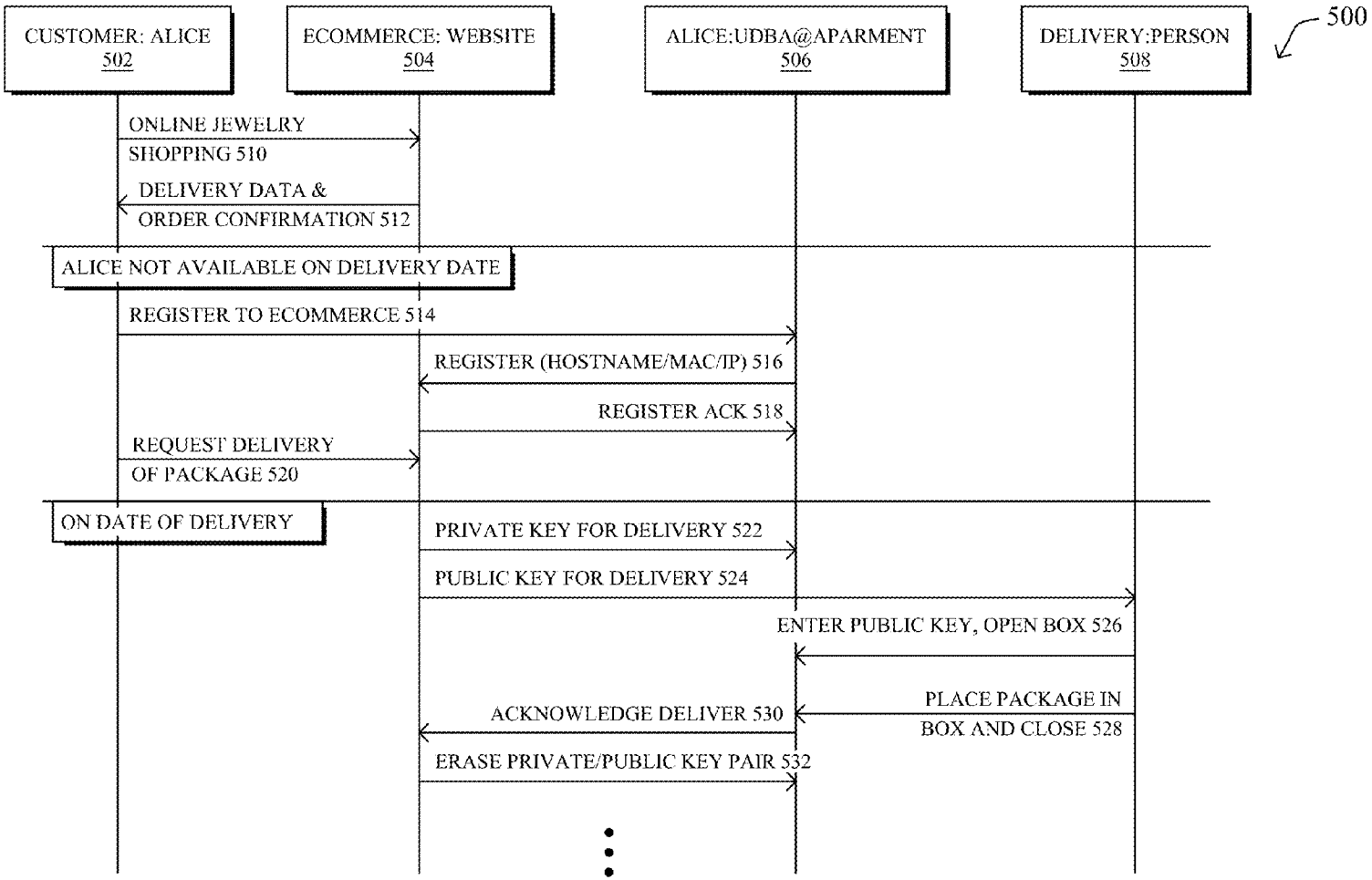
FIGS. 5A-5B illustrates an example data flow diagram of a security mechanism for a smart postal box.
Figure 5B:
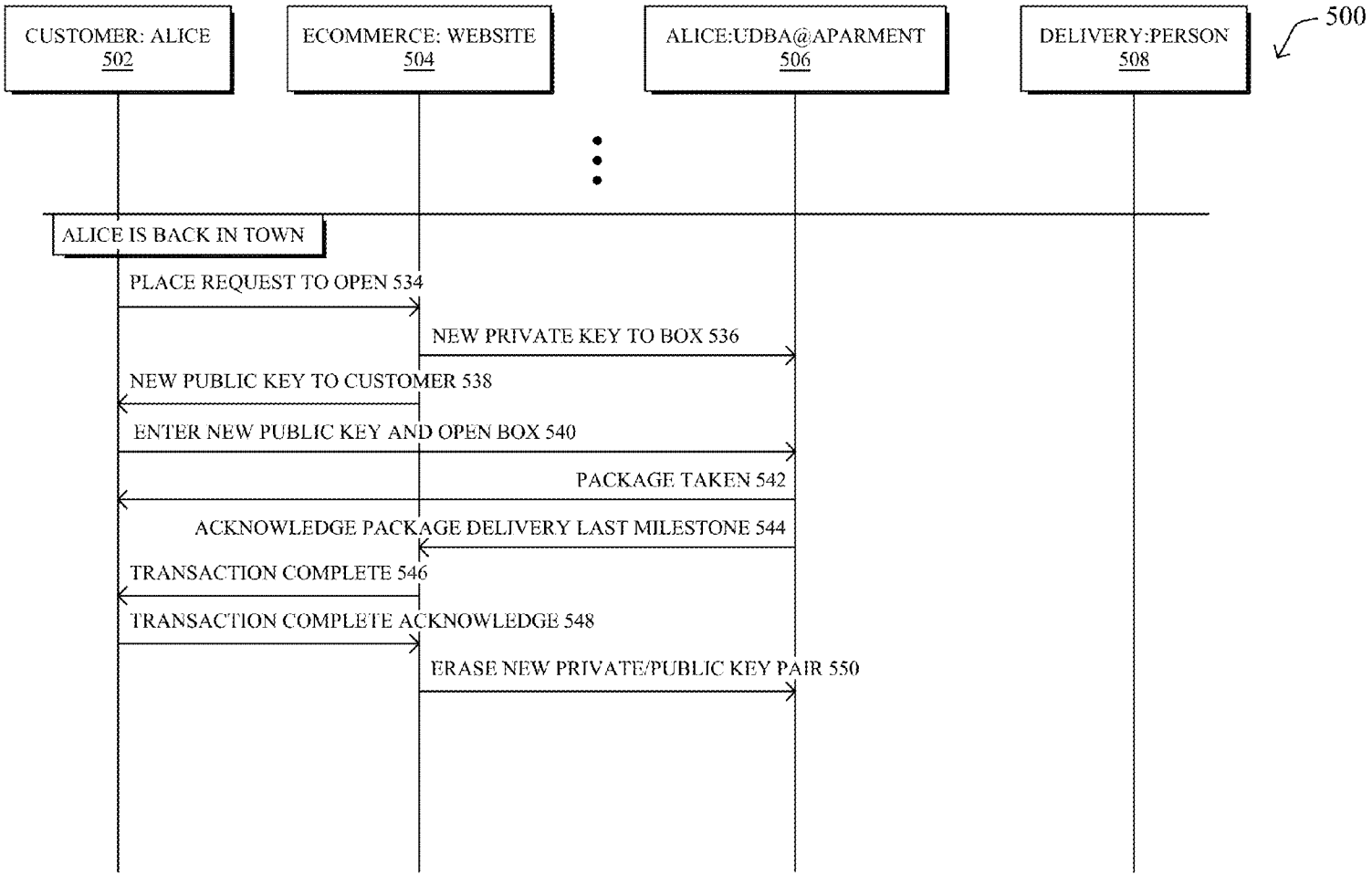

Referring now to FIGS. 5A-5B, an example data flow diagram 500 of a security mechanism for a smart postal box such as smart postal box 102 is shown, according to various embodiments. As shown, a number of different entities may cooperate to securely deliver and retrieve a package. In particular, as shown, a customer 502 may interact (e.g., via a user device 406) with an e-commerce website 504 (e.g., hosted on one of servers 404). In turn, website 504 may interact with the smart postal box, such as via an account 506 associated with customer 502. Finally, a delivery entity 508 (e.g., a delivery person, UAV 104, or other delivery entity) may interact with the smart postal box during delivery of the package.

At step 510, assume that customer 502 orders jewelry or other goods from e-commerce website 504. In response, website 504 may generate and provide an order confirmation and/or scheduled delivery date and time, in step 512. If, for example, customer 502 is not available on the scheduled delivery date, she may opt to register her smart postal box with website 504, to schedule delivery to the smart postal box. For example, as shown in step 514, customer 502 may send a request for delivery to account 506 associated with her smart postal box. In response, account 506 may send registration information to website 504 associated with the smart postal box (e.g., a hostname, MAC or IP address, etc.), in step 516. At step 518, website 504 may acknowledge the registration process to account 506. Once the smart postal box has been registered with website 504, customer 502 may subsequently request delivery of the package to the smart postal box, at step 520. Such a request may include, for example, information regarding a designated recipient that is authorized by customer 502 to retrieve the package from the smart postal box on her behalf.

On the day of delivery or at any other time prior to delivery, website 504 may generate and send a unique private key to account 506, at step 522. In addition, website 504 may send a public key to a device associated with delivery entity 508 (e.g., a portable device operated by a human delivery person) or directly to delivery entity 508 (e.g., a UAV, etc.) that performs the actual delivery of the package, as shown in step 524. During the actual delivery, delivery entity 508, or the device associated therewith, may use the public key to open the smart postal box, in step 526. In step 528, delivery entity 508 may then place the package in the smart postal box and close it. At this point, smart postal box securely stores the package. Optionally, website 504 may request erasure of the public and private key pair from the smart postal box, as shown in step 532.

As illustrated in FIG. 5B, at a later date (e.g., after customer 502 is back in town or when an authorized recipient is available), customer 502 requests access to smart postal box via website 504, as shown in step 534. In response, website 504 generates a new private key and sends it to the smart postal box, in step 536. In addition, in step 538, website 504 sends a corresponding public key to the device operated by customer 502. At step 540, customer 502 then uses the public key to gain access to the smart postal box. In some embodiments, customer 502 may enter the key manually via a keypad or other input device coupled to the smart postal box. In other embodiments, customer 502 may transfer the key to the smart postal box via a computing device (e.g., a portable electronic device, etc.), via either a wireless or wired connection.

Once the smart postal box is open, customer 502 is able to retrieve the package, as shown in step 542. In some embodiments, the smart postal box may acknowledge the completed delivery to website 504, at step 544. At step 546, website 504 may send a completed transaction notification to the device operated by customer 502, which may be acknowledged in step 548. At step 550, website 504 may also request erasure of the private and public key pair used by customer 502 to gain entry to the smart postal box.

Figure 6:
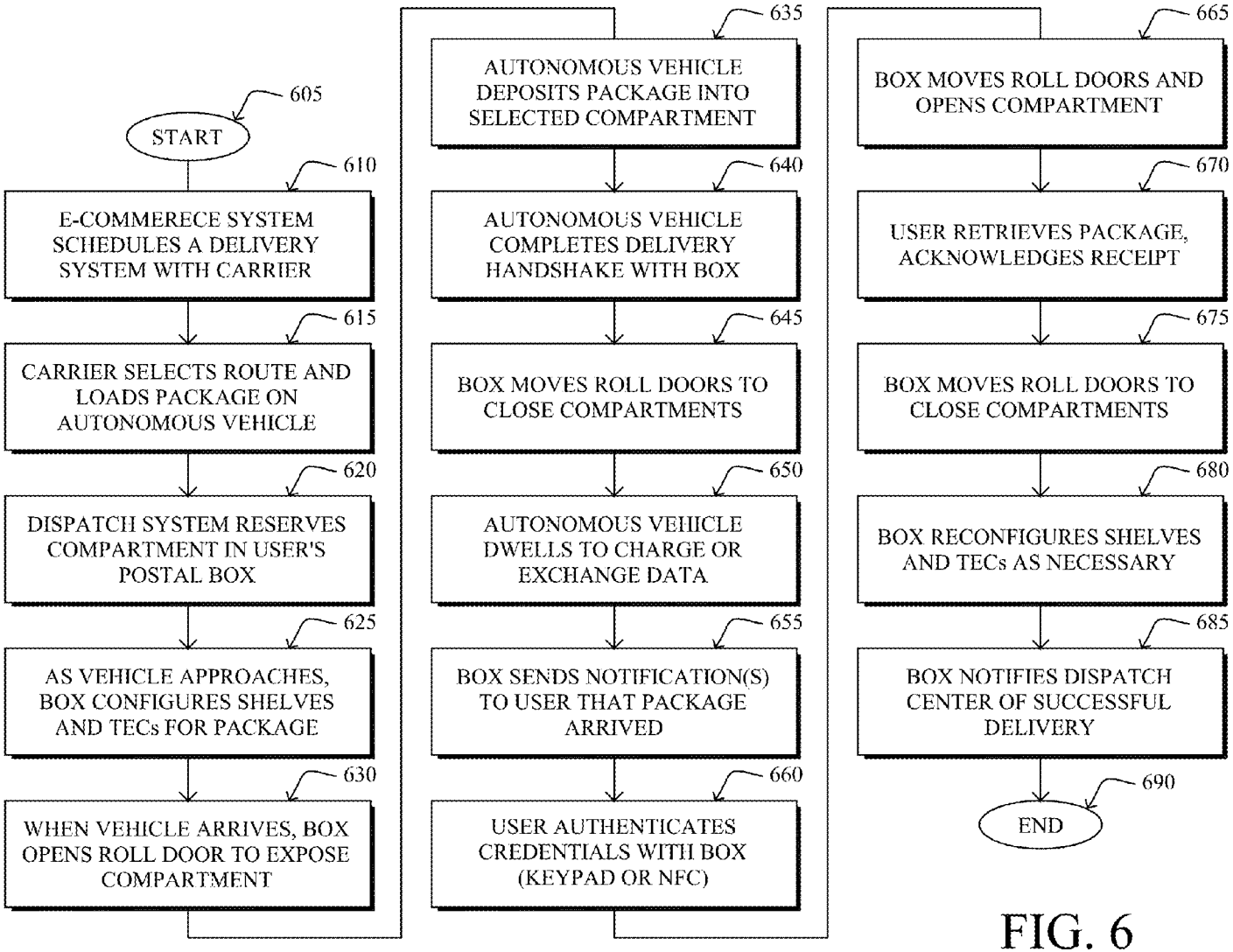
FIG. 6 illustrates an example procedure for delivering a package to a smart postal box.

Referring now to FIG. 6, an example procedure 600 is shown for delivering a package via the package delivery system disclosed herein, according to various embodiments. In general, procedure 600 may be used by a package delivery system that includes a smart postal box. Procedure 600 may begin at a step 605 and continue on to step 610 where, as described in greater detail above, an e-commerce system may schedule a package delivery with a carrier. Such an order may be, for example, an automatic prescription refill, a restaurant delivery order, an arranged package drop-off or pickup, or any other order placed through an e-commerce system (e.g., a website or other service provided by one or more of servers 404) that triggers delivery of a package. As part of the scheduled delivery, the data from the e-commerce system may be provided to a computer system of the delivery carrier. For example, the e-commerce system may provide details regarding the pickup and/or drop-off addresses for the package, details regarding the size or weight of the package, a desired delivery timeframe (e.g., overnight, two day, etc.), or any other such information that may be used by the delivery service to coordinate delivery of the package.

Once delivery is scheduled and the delivery service picks up the package at its point of origin, procedure 600 may continue as follows. At step 615, the delivery service may run the package through a sorting and distribution center, assign the package to a local route for delivery, and load the package onto a delivery vehicle. In some embodiments, an autonomous delivery vehicle, such as a UAV or a self-driven delivery truck may service the assigned route. At step 620, the dispatch system of the delivery service may contact the addressee's smart postal box, to reserve an internal shelf or combination of shelves large enough to accommodate the package, when an estimate of the delivery time is available. In some embodiments, the dispatch system may also communicate the delivery time estimates and/or any encrypted credentials (e.g., passwords, PINs, etc.) that may be required to retrieve the package from the smart postal box. Once the smart postal box acknowledges adequate space is available and the slot is reserved, the delivery vehicle is dispatched on a route that includes the location of the box.

While en-route, the vehicle and smart postal box may exchange estimated time of arrival (ETA) data over a wireless data connection. At step 625, when the delivery vehicle is within a threshold ETA and/or distance from the smart postal box (e.g., a few miles or minutes away, etc.), the smart postal box may configure itself to accommodate the incoming package. For example, as detailed above, the smart postal box may operate its internal motor to adjust the mechanical positions of its internal shelves, adjust the internal temperature of the resulting compartment (e.g., by energizing thermo-electric coolers or heaters, etc.), or enabling beacon lights, in preparation of the arrival of the delivery vehicle. As described above, such beacon lights may broadcast an identification code modulated with a unique identifier for the particular box and be repeated every few seconds. If many smart postal boxes are in the same geographic area (e.g., within a radius of GPS uncertainty, etc.), such an identifier may be used assure the delivery vehicle is approaching the intended smart postal box. In some embodiments, the range of a beacon data link may be up to a mile in good weather. For example, when the delivery vehicle arrives at the postal box, the vehicle may use the beacon lights to perform a fine alignment between its package handling robotic equipment and the doors/shelves of the postal box.

At step 630, the delivery vehicle may message the smart postal box (e.g., via a near-field communication link, an optical link, etc.) to inform the box that the delivery is ready, and the box actuates one or both of its roll doors to expose an internal compartment. As noted previously, the exposed compartment may be pre-sized to accommodate the package being delivered. In some cases, the internal temperature of the compartment may also be adjusted prior to delivery, according to any specific requirements associated with the package (e.g., delivered food may require a particular storage temperature, etc.).

At step 635, the delivery vehicle deposits the package into the corresponding internal compartment of the smart postal box using robotic package handling equipment resident on the vehicle. For example, as shown in FIG. 1, the delivery vehicle may operate a robotic gripper 118 to deposit package 110 into smart postal box 102. In another embodiment, the smart postal box may be equipped with robotic package handling equipment configured to complete the handoff with the delivery vehicle.

At step 640, the delivery vehicle may perform an electronic handshake with the smart postal box, to ensure that both the vehicle and the box agree that the delivery transaction is complete. For example, the vehicle and the box may exchange acknowledgements that the package has been placed into the internal compartment of the box. In one embodiment, the delivery vehicle and/or the smart postal box may forward an indication of the delivery acknowledgement to a remote server, such as that of the delivery service or e-commerce service (e.g., to trigger a payment for delivery, to trigger a delivery notification to the addressee, etc.).

At step 645, the smart postal box may close its roll doors, to prevent further access to the compartment in which the package was delivered. Until access is granted again to the compartment (e.g., when the addressee retrieves the package), the internal compartment may provide protection to the package against the elements, theft, etc.

At step 650, the delivery vehicle may optionally dwell at the smart postal box after delivery is complete, to receive a charge and/or exchange further data with the smart postal box. For example, a connection may be made between the vehicle and the box, to allow some of the energy stored in the box's batteries to be passed rapidly to the vehicle, thereby providing a quick charge to the vehicle. For example, the smart postal box may charge an electric UAV or an electric/electric hybrid road vehicle, either before, during, or after delivery is complete. A few minutes of charging at a power rating substantially larger than the vehicles normal operational power consumption (e.g., two to ten times, etc.) can permit many minutes of additional fly or drive time, greatly extending the delivery range of the vehicle, and reducing the risk of running out of energy before the vehicle returns to base. In some cases, the smart postal box and the vehicle may also exchange data. For example, the exchanged data may update the status of the smart postal box, the vehicle may use the box as an Internet connection or network relay point (e.g., to upload its status to a server, retrieve any new routing orders or changes, etc.), perform test flight procedures, or exchange any other information.

At step 655, the smart postal box may send one or more notifications to user devices, to indicate that the package has been delivered. For example, the box may notify the addressee or another designated recipient (e.g., an authorized person designated by the addressee) that the package is ready for retrieval. In some embodiments, the smart postal box may be operable to send the notification directly (e.g., as a stand-alone email server, text message server, via an audible alarm, via one or more flashing lights, etc.). In other embodiments, the smart postal box may send the notification via a networked server (e.g., via the delivery vehicle) that is configured to send a delivery message to a user device.

At step 660, an authorized recipient may visit the smart postal box and authenticate his or her credentials with the box. As noted above, such a recipient may be pre-authorized to receive the package by the addressee of the package. For example, the addressee may authorize another household member, a neighbor, a friend, etc., to retrieve the delivered package on his or her behalf. In one embodiment, the recipient may provide authentication information to the smart postal box via a keypad or other user interface device located on the smart postal box. In other embodiments, the recipient may provide authentication information to the smart postal box by way of a radio frequency identification (RFID) tag, one or more biometric readers, a password entered via a user device (e.g., a smartphone connected to the box via the Internet or near-field communication link, etc.), or combinations thereof. Also as noted above, the authentication may be based on a public key encryption mechanism whereby public and private keys are used to encrypt the authentication information supplied by the recipient.

At step 665, the smart postal box verifies the credentials of the recipient against those associated with the delivery order of the carrier and, in response, actuates its roll doors to expose the internal compartment housing the package.

Similar to when the package itself was delivered, the smart postal box may actuate its doors in such a way that only exposes the compartment housing the package to be delivered, in one embodiment. Such a feature may be used, for example, when the smart postal box is shared by multiple users (e.g., if the smart postal box is used for a multi-unit building, etc.).

At step 670, once the internal compartment is exposed, the recipient retrieves the package and, optionally, acknowledges receipt of the package. Such an acknowledgement may correspond to an e-signature supplied by the user, input provided to a keypad on the smart postal box or via a portable electronic device, a biometric reading, etc. In another embodiment, the smart postal box may independently confirm receipt of the package by the user via a camera, weight sensor in the internal compartment, safety sensors associated with the door (e.g., sensors configured to determine whether a user's body parts are located within the box), or via other such means.

At step 675, the smart postal box actuates one or more of its doors, to seal off its internal compartment(s) after the recipient retrieve the package. As noted previously, one or more safety sensors or cameras may detect when the user is clear of the smart postal box, before the doors are closed. In some cases, the smart postal box may generate an alert (e.g., an audible message, a displayed message, etc.), if the user's person is still within range of the doors.

At step 680, the smart postal box may reconfigure its internal compartments as necessary, to return to a default position. For example, if the internal compartments of the smart postal box were reconfigured to accommodate a large package, the smart postal box may reconfigure itself to provide smaller compartments after the addressee or other authorized recipient retrieves the large package. In another example, if the smart postal box provides climate control to the compartment housing the delivered package, the smart postal box may return the internal temperature to a default setting or turn off the heating or cooling systems of the box.

At step 685, the smart postal box may notify the dispatch system of the delivery service that delivery is complete and that an authorized recipient has collected the package. In some embodiments, the notification may include information regarding the recipient such as the name or other identification of the recipient, a photograph or video of the recipient retrieving the package from the smart postal box, a timestamp corresponding to when the package was retrieved, etc. Procedure 600 then ends at a step 690.

As would be appreciated, some or all of the steps of procedure 600 may be performed without requiring the smart postal box to maintain a persistent Internet connection. In particular, certain steps may be performed between the smart postal box and a user device or delivery vehicle using a near-field communication link. Such entities may store and forward messages, status reports, commands, acknowledgements, etc. via the Internet on behalf of the box, in some embodiments. Conversely, in further embodiments, the smart postal box may store and forward messages on behalf of the vehicle or user device. Also, while an autonomous delivery vehicle may perform procedure 600, a human delivery driver may perform certain steps, in other embodiments. For example, the delivery driver may operate one or more user devices (e.g., a handheld computer, a dashboard of a delivery truck, etc.) that perform the step in lieu of an autonomous delivery vehicle.

Figure 7:
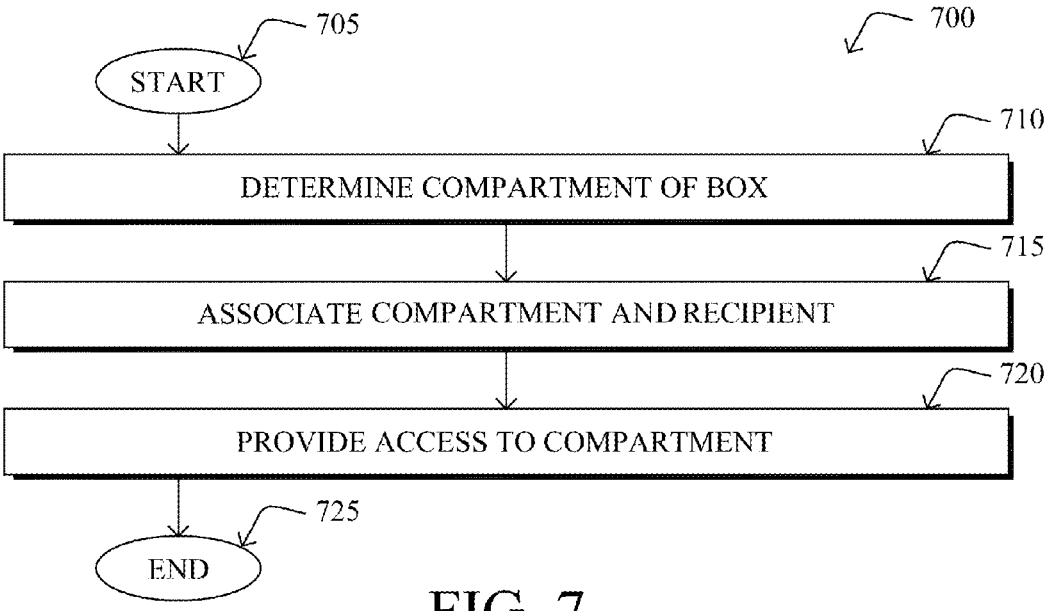
FIG. 7 illustrates an example simplified procedure for providing access to a smart postal box.

FIG. 7 illustrates an example simplified procedure for providing access to a smart postal box, in accordance with one or more embodiments described herein. The procedure 700 may start at step 705, and continues to step 710, where, as described in greater detail above, a controller of a smart postal box determines a particular compartment of the box in which a package is to be delivered. In various embodiments, the controller may be resident to the postal box or may be implemented in a distributed manner. In some cases, the controller may determine the compartment based on the proximity of the smart postal box to an address associated with a package to be delivered. For example, a compartment of a smart postal box may be reserved to receive a delivered package, based on the smart postal box being close to the address of the addressee of the package. In further embodiments, the controller may determine the compartment based on characteristics of the smart postal box and/or the compartment itself. For example, the controller may determine the compartment based on the size or shape of the package to be delivered in relation to the compartment, the current status of the compartment (e.g., the compartment is currently occupied with another package, the compartment is scheduled to become empty at a certain time, etc.), climate control capabilities of the compartment or smart postal box (e.g., to maintain an internal temperature required by the package, etc.), or other such information.

At step 715, the controller may associate the package with an authorized recipient and/or one or more other authorized entities, as described in greater detail above. For example, the controller may associate the package with the addressee to whom the package is being delivered. In some embodiments, the addressee may also authorize one or more other users to retrieve the package from the smart postal box. Non-limiting examples of authorized recipients may include, but are not limited to, household members or roommates of the addressee, neighbors of the addressee, employees of the addressee, friends of the addressee, co-workers of the addressee, etc. In some cases, the controller may also verify that the recipient meets certain criteria to receive the package, before authorizing the recipient. For example, the controller may verify the recipient's age, if the package being delivered requires an authorized recipient to be above a specified age (e.g., packages containing alcohol, tobacco, medications, currency, etc.). In yet additional embodiments, the controller may associate the compartment with a delivery entity (e.g., a UAV, an automated delivery truck, a human delivery person, etc.).

At step 720, the controller provides the authorized entity access to the compartment, as detailed above. In some embodiments, the controller may cause the actuation of one or more doors of the smart postal box to align the doors with the particular compartment. For example, the smart postal box may actuate roll doors to expose the compartment that houses the delivered package. In another embodiment, the smart postal box may actuate the roll doors to allow delivery of the package into the compartment. In one embodiment, the controller may actuate the doors to allow access to only the compartment housing the package, thereby providing security to any other packages also stored by the smart postal box. Procedure 700 then ends at step 725.

Figure 8:
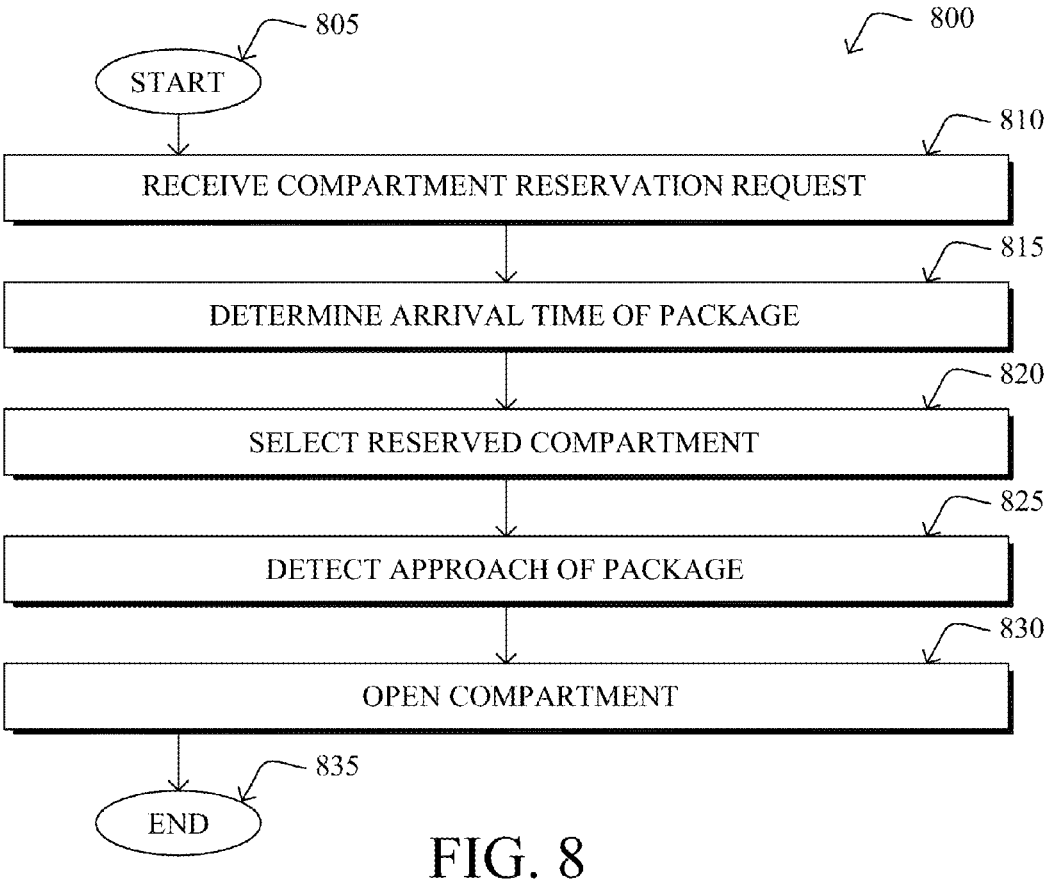
FIG. 8 illustrates an example simplified procedure for receiving a delivered package at a smart postal box.

FIG. 8 illustrates an example simplified procedure for receiving a delivered package at a smart postal box, in accordance with one or more embodiments described herein. The procedure 800 may start at step 805, and continues to step 810, where, as described in greater detail above, a controller of a smart postal box receives a compartment reservation request. For example, the controller may receive such a request from a server of a package delivery service or from an e-commerce website. The request may include various information regarding the package itself (e.g., the weight, dimensions, storage temperature requirements, etc. of the package), information regarding the scheduled delivery (e.g., when the package is actually going to occupy the compartment), the type of delivery method (e.g., via UAV, via autonomous truck, via human delivery, etc.) the addressee, and/or any other conditions regarding the delivery (e.g., any age requirements for a user picking up the package, etc.).

At step 815, as described in greater detail above, the controller determines the arrival time of the package based on the compartment reservation request. For example, the controller may receive routing or position information for a delivery vehicle, the package itself, or any other information in the compartment reservation request that may indicate when the package will actually be deposited into the smart postal box. In some embodiments, the arrival time may correspond to a particular date. In further embodiments, the arrival time may also correspond to a particular time of day or timeframe. For example, a delivery vehicle may visit the smart postal box around a particular time of day (e.g., around 3:00 PM, etc.). This information may be used by the controller to reserve the requested compartment, configure itself based on the request (e.g., to accommodate the requirements of the package), and/or coordinate package pickups and deliveries of different packages.

At step 820, the controller selects a reserved compartment for the package, as described in greater detail above. In embodiments, the controller may select the compartment based on any or all of the following: the dimensions of the package indicated in the reservation request (e.g., to match the package to an appropriately sized compartment), the weight of the package indicated in the reservation request, the current or expected occupancy of the box's compartments at the determined arrival time, climate control capabilities of the compartment that support any requested environmental conditions in the reservation request (e.g., a specific temperature, humidity, etc.), the type of delivery (e.g., via UAV, autonomous truck, etc.), or the like.

At step 825, the controller detects the approach of the package, as detailed above. In various embodiments, the controller may receive an indication of an approaching delivery vehicle carrying the package via a near-field communication link with the vehicle, via the Internet (e.g., a message from a server of the delivery service), via one or more beacons located on the smart postal box, via an optical communication link with the vehicle, or using any other form of communication. In some embodiments, the controller may detect the approach of the package in response to the delivery vehicle being with a predefined distance or time of the smart postal box (e.g., fifty feet away, one minute away, etc.).

At step 830, as detailed above, the controller of the smart postal box opens the compartment, to allow the deposit of the package into the reserved compartment when the package arrives at the smart postal box. For example, the top of the smart postal box may include one or more rolling doors that the controller can actuate to expose an internal compartment of the smart postal box to a delivery UAV. In other embodiments, a side door of the postal box may be actuated, to allow an autonomous truck or human delivery person to deposit the package into the smart postal box. Procedure 800 then ends at step 835.

It should be noted that while certain steps within procedures 500-800 may be optional as described above, the steps shown in FIGS. 5A-8 are merely examples for illustration, and certain other steps may be included or excluded as desired. Further, while a particular order of the steps is shown, this ordering is merely illustrative, and any suitable arrangement of the steps may be utilized without departing from the scope of the embodiments herein. Moreover, while procedures 500-800 are described separately, certain steps from each procedure may be incorporated into each other procedure, and the procedures are not meant to be mutually exclusive.

The techniques described herein, therefore, provide for a fully or partially automated package delivery system. In some aspects, the package delivery system may include autonomous delivery vehicles (e.g., UAVs, self-driving trucks, etc.) and may also support human-driven vehicles. In another aspect, a smart postal box is disclosed that allows for independent deliveries to be scheduled and provide security to different internal compartments of the smart postal box. The smart postal box may also reconfigure itself automatically to accommodate the needs of a given package (e.g., based on the size or weight of the package, the storage temperature requirements of the package, etc.) and/or provide information regarding its internal conditions to another device (e.g., a delivery vehicle, a server of the delivery service, etc.). In yet another aspect, authorization mechanisms are disclosed that allow human users (e.g., a delivery person, the addressee of the package, etc.) access to a compartment of a smart postal box (e.g., via a public and private key generation mechanism).

While there have been shown and described illustrative embodiments that provide for the automated delivery of packages, it is to be understood that various other adaptations and modifications may be made within the spirit and scope of the embodiments herein. For example, the embodiments have been shown and described herein primarily with respect to certain computing elements. However, the embodiments in their broader sense are not as limited, and may, in fact, be distributed across multiple computing devices. For example, it is to be appreciated that a controller of a smart postal box may be resident in the box itself or, alternatively, may be located remotely therefrom and implemented using one or more computing devices/servers. Further, while certain communication protocols are disclosed herein, any other form of wireless or wired communication may be used, without deviating from the teachings herein. In addition, while the terms "package" and "parcel" are used herein, these terms are intended to be inclusive of both boxed and unboxed deliverables (e.g., mail, magazines, etc.).

The foregoing description has been directed to specific embodiments. It will be apparent, however, that other variations and modifications may be made to the described embodiments, with the attainment of some or all of their advantages. For instance, it is expressly contemplated that the components and/or elements described herein can be implemented as software being stored on a tangible (non-transitory) computer-readable medium (e.g., disks/CDs/RAM/EEPROM/etc.) having program instructions executing on a computer, hardware, firmware, or a combination thereof. Accordingly this description is to be taken only by way of example and not to otherwise limit the scope of the embodiments herein. Therefore, it is the object of the appended claims to cover all such variations and modifications as come within the true spirit and scope of the embodiments herein.

What is claimed is:

1. A method, comprising:

determining, by a controller, a particular compartment of a plurality of compartments of a smart postal box in which a package is to be delivered;

associating, by the controller, the particular compartment with an authorized entity; and providing, by the controller, the authorized entity access to the particular compartment by actuating and moving rolling doors of the smart postal box to only expose the particular compartment.

2. The method of claim 1, further comprising:

receiving a compartment reservation request for the package;

determining an arrival time of the package based on the compartment reservation request;

selecting the particular compartment of the smart postal box as reserved based on the compartment reservation request;

detecting an approach of the package; and opening the particular compartment when the package arrives at the smart postal box.

3. The method of claim 2, further comprising:

adjusting compartment shelves of the smart postal box to form the particular compartment, based on a size of the package indicated in the compartment reservation request.

4. The method of claim 2, wherein the particular compartment is determined based in part on a delivery type indicated by the compartment reservation request.

5. The method of claim 1, further comprising:

determining a required temperature for storing the package within the particular compartment; and adjusting a temperature of the particular compartment based on the required temperature.

6. The method of claim 1 further comprising:

closing the rolling doors to secure the particular compartment;

enabling a compartment lock to secure the particular compartment;

receiving an authentication key to unlock the compartment lock; and confirming the authentication key to expose the particular compartment to authorized entity.

7. The method of claim 6, wherein confirming the authentication key comprises:

decrypting the authentication key using a private key received from a registration server via a network.

8. The method of claim 7, wherein the registration server generates the private key in response to a recipient of the package scheduling delivery of the package.

9. The method as in claim 6, further comprising:

receiving the authentication key via a user interface of the smart postal box.

10. The method as in claim 6, further comprising:

receiving the authentication key via a portable electronic device.

11. The method of claim 1, further comprising:

transmitting an alert to the authorized entity, in response to receiving the package within the particular compartment; and securing the package until the package is retrieved by the authorized entity.

12. A method, comprising:

receiving, at a controller, a compartment reservation request for a smart postal box;

determining an arrival time of a package to be delivered to the smart postal box based on the compartment reservation request;

selecting, by the controller, a particular compartment of a plurality of compartments of the smart postal box to be reserved for the package based on the compartment reservation request and the arrival time of the package;

detecting, by the controller, an approach of the package; and opening, by the controller, the particular compartment by actuating and moving rolling doors of the postal box to only expose the particular compartment, in response to the detected approach of the package.

13. The method of claim 12, further comprising:

adjusting a size of the particular compartment by causing one or more compartment shelves of the smart postal box to move, based on a size of the package indicated by the compartment reservation request.

14. The method of claim 12, wherein the particular compartment is selected based in part on a delivery type indicated by the compartment reservation request.

15. The method of claim 14, wherein the delivery type corresponds to one of: an unmanned aerial vehicle (UAV), an automated truck, or a human delivery person.

16. The method of claim 15, wherein the delivery type corresponds to a UAV, and wherein the selected particular compartment is a topmost compartment in the smart postal box.

17. The method of claim 12, further comprising: receiving a private key from a registration server via a network;

receiving an authentication key to access the particular compartment;

validating the authentication key by decrypting the authentication key using the private key; and opening the one or more doors by aligning the one or more doors with the particular compartment, in response to validating the authentication key.

18. The method of claim 12, wherein the particular compartment is selected based on a required climate for the package indicated by the compartment reservation request.

* * * * *